US005129984A

United States Patent [19]

Tomashauser et al.

[11] Patent Number: 5,129,984

[45] Date of Patent: Jul. 14, 1992

[54] MACHINE FOR WRAPPING FOIL ABOUT THE TOPS AND NECKS OF BOTTLES

[75] Inventors: Josef Tomashauser, Willich; Rudolf Zodrow, Düsseldorf, both of Fed. Rep. of Germany

[73] Assignee: ETI-TEC Maschinenbau GmbH, Erkrath, Fed. Rep. of Germany

[21] Appl. No.: 593,226

[22] Filed: Oct. 5, 1990

Related U.S. Application Data

[63] Continuation-in-part of Ser. No. 311,609, Feb. 15, 1989, Pat. No. 4,976,803.

[30] Foreign Application Priority Data

Oct. 7, 1989 [DE] Fed. Rep. of Germany ..... 3933568

[51] Int. Cl.[5] ..... B65C 3/22

[52] U.S. Cl. ..... 156/567; 156/DIG. 12; 156/DIG. 16

[58] Field of Search ..... 156/566, 567, DIG. 12, 156/DIG. 13, DIG. 14, DIG. 15, 568

[56] References Cited

U.S. PATENT DOCUMENTS

| | | | |
|---|---|---|---|
| 4,172,753 | 10/1979 | Benoit | 156/566 X |
| 4,242,168 | 12/1980 | Carter | 156/568 X |
| 4,613,397 | 9/1986 | Buchholz et al. | 156/567 X |

FOREIGN PATENT DOCUMENTS

| | | |
|---|---|---|
| 391729 | 8/1921 | Fed. Rep. of Germany . |
| 3104807 | 9/1984 | Fed. Rep. of Germany . |
| 8512906 | 5/1989 | Fed. Rep. of Germany . |
| 1294574 | 4/1962 | France . |

*Primary Examiner*—David A. Simmons
*Assistant Examiner*—Chester T. Barry
*Attorney, Agent, or Firm*—Nils H. Ljungman & Associates

[57] ABSTRACT

A bottle labelling machine for pressing labels on bottles. The machine includes a transport star wheel with receptacles for the bottles located on its circumference. A support located above the transport star wheel has application elements located on the circumference of said support. The circular orbit of the application elements has a smaller diameter than and diverges in relation to the orbit of the receptacles.

19 Claims, 7 Drawing Sheets

MACHINE FOR WRAPPING FOIL ABOUT THE TOPS AND NECKS OF BOTTLES

This application is a continuation-in-part application of U.S. Ser. No. 07/311,609, now U.S. Pat. No. 4,976,803, filed on Feb. 15, 1989.

BACKGROUND OF THE INVENTION

1. Field of the Invention

This invention relates to an application or pressing station for foil sheets placed around the neck and the top of bottles. The application or pressing station has a transport star wheel that rotates around a first axis of rotation. The transport star wheel has receptacles located on its circumference for receiving the bottles. The station includes application or pressing elements that can be lowered onto the tops of the bottles and are positioned on the circumference of a support located above the transport star wheel. The support rotates around a second axis of rotation that is offset in relation to the first axis of rotation. The orbits of the receptacles on the transport star wheel and the application or pressing elements are synchronized with one another over a section of the station positioned between the bottle entrance and exit of the transport star wheel, where the application or pressing elements are lowered.

2. Background Information

Application stations of this type may form part of a labelling machine in which the bottles are held and transported in a turntable where foil sheets are applied. One problem with such labelling machines is that collisions may occur during the transfer of the bottles from the turntable into the transport star wheel, when it performs the function of a discharge star wheel. That is because the orbits of the centering heads that act on the bottle tops on the turntable, and the application or pressing elements that act on the bottle tops in the discharge star wheel, overlap in the transfer region between the turntable and the discharge star wheel. To obtain optimal synchronization during the application of the foil sheets, special precautions must be taken in the control and design of the application or pressing elements, if there is a lowerable application or pressing element above each receptacle, to avoid a collision between the centering heads and the application or pressing elements in the transfer region between the turntable and the discharge star wheel.

German Patent No. 31 04 807 C2, discloses a label application or pressing station in which precautions have been taken to avoid such collisions. These precautions include pivoting each application or pressing element to the side from its position above the receptacle, into a position which lies outside the area passed over by the centering head of the turntable. Only when the application or pressing element has passed the transfer region, between the turntable and the discharge star wheel, is it pivoted over the bottle top of the corresponding receptacle and lowered for the application or pressing of the foil sheet. Disadvantages of such an application or pressing station are that a great deal of space is required for the pivoting movement and the drive and transmission that create the pivoting and subsequent lowering movements. Therefore, complex and expensive equipment is required.

These disadvantages associated with the pivoting movement are not present with another application or pressing station described in German Patent No. 33 45 228 A1. In that station, the application or pressing elements are non-pivotally mounted on the circumference of a support. The support has a smaller diameter than, and is mounted off-center in relation to, the discharge star wheel in such a way that the orbit of the application or pressing elements remains outside of the orbit of the receptacles on the turntable. The orbit of the application or pressing elements approximately coincides with the orbit of the receptacles of the feeder star wheel along only on a small segment between the bottle entrance of the discharge star wheel and the exit of the discharge star wheel. In comparison to the first application or pressing station described above, this application or pressing station has the disadvantage that only approximate synchronization can be achieved over the above-mentioned segment. As long as this application or pressing station is operated below the maximum possible capacity, that deviation from absolute synchronization is not critical.

German Patent No. G 85 12 906.2 discloses a foil application or pressing station in which the orbit of the application or pressing elements that are mounted on a support is also smaller than the orbit of the receptacles of the discharge star wheel. Also, the center of the orbit is off-center in relation to the orbit of the receptacles of the discharge star wheel to achieve synchronization in the area in which the application or pressing elements are lowered. The otherwise circular orbit of the receptacles is displaced by the corresponding bottle guide. That bottle guide includes a stationary guide rail against which the bottles are flexibly braced by rubber cushions and are pressed into the receptacles. During the rotation of the discharge star wheel, the bottles are moved radially. That movement results in a significant load on the bottles that is, however, acceptable at low production rates.

One common element found in all of the above described application or pressing stations is that for the required lowering movement of the application or pressing elements, the elements are movably mounted in a support and a cam drive is provided for each application or pressing element. Therefore, the cost of equipment for the lowering devices of the application or pressing elements is significant. Additionally, because of that guidance system for the application or pressing elements and their drive mechanisms, the area above the discharge star wheel is almost completely occupied by equipment.

On such pressing stations, the rotating paths of the delivery positions of the turntable and of the delivery star wheel overlap, so that the bottles can be transferred in synchronization from the turntable to the delivery star wheel. Since during transport of the bottles both in the turntable and in the delivery star wheel, elements such as centering heads grip the tops of the bottles when the bottles are on the turntable and pressing elements grip the tops of the bottles when the bottles are on the delivery star wheel, it is difficult to achieve a collision-free fit of the elements of the turntable and of the delivery star wheel in the overlapping region. Also, for purposes of transferring the bottles from the turntable to the delivery star wheel at the proper angle of rotation, the bottles in the turntable must be held as long as possible in a rotation-free manner by axial bracing between the turntable which supports the bottom of the bottle, and the centering element which grips the top. For a collision-free passage of the pressing elements of the delivery star wheel, it is necessary to move the pressing elements out of the overlapping area during the passage.

In German Laid Open Patent Appln. No. 31 04 807 C2, which corresponds to U.S. Pat. No. 4,414,056, this problem is approached by equipping each pressing element so that it can pivot to one side from its position above the receiving position, into a position which lies outside the portion of the turntable traversed by the centering head of the turntable. Only when the pressing element has passed the overlapping area can it be pivoted over the bottle top of the corresponding receiving position, and then lowered to press the foil sheet. One disadvantage of such pressing stations is that a great deal of space is required for the pivoting movement, and the drive and transmission mechanisms required for the pivoting motion and the subsequent axial movement are quite complex and expensive.

These disadvantages related to the pivoting movement do not occur on another pressing station disclosed in German Laid Open Patent No. 35 15 730 A1. In that patent, the pressing elements are located so that they pivot on the circumference of a support, that has a smaller diameter than that of the delivery star wheel, and is mismatched in relation to the delivery star wheel. With that configuration, the path of the pressing elements lies outside the path of the receiving positions of the turntable and only above a short segment of the path of the receiving positions of the delivery star wheel. A disadvantage, however, is that synchronization between the receiving positions of the delivery star wheel and the pressing elements can only be achieved over the above-mentioned short segment, and then only approximately, which has a negative effect on the quality of the pressing of the foil sheet.

On the pressing stations described above, however, a collision-free passage of the pressing elements on the delivery star wheel and the centering heads on the turntable or synchronization between the receiving positions of the delivery star wheel and the pressing elements is only guaranteed during operation when there is no jamming up at the outlet of the delivery star wheel. To prevent major damage to the pressing station when there is a jamming up at the outlet of the delivery star wheel, the delivery star wheel is coupled with the drive by means of a slip clutch. If a jamming up does occur, then the delivery star wheel can slip in relation to the drive. That configuration requires pivotable pressing elements which are oriented concentrically to the receiving positions causing the synchronization between the turntable and the pressing elements is lost. When rotation continues, therefore, even with the pressing elements pivoted back, collisions may occur. In another pressing station of the prior art described above, with the support for the pressing elements offset and not torsionally connected to the delivery star wheel, a slipping of the delivery star wheel in relation to the drive as a result of a jam leads to an offset between the receiving positions and the pressing elements corresponding to the receiving positions in the pressing area. Once again, the result is that the pressing elements can no longer be placed centrally over the bottle tops.

OBJECT OF THE INVENTION

One object of the present invention is to create a foil sheet application or pressing station in which sufficient synchronization between the application or pressing elements and the bottles transported by the transport star wheel is achieved and wherein a low equipment cost for the mounting of the application or pressing elements and their stroke movement is achieved.

SUMMARY OF THE INVENTION

This object is achieved by the present invention.. With the present invention, the planes of the orbits of the receptacles and the application or pressing elements are inclined in relation to one another so that the required stroke movement of the lowerable application or pressing elements is produced as a direct result of the inclined position of the orbit of the application or pressing elements.

With the present invention, there is no need for an axial mounting of the application or pressing elements or a cam-controlled drive for the stroke movement because the inclined position of the circular orbit causes the necessary stroke movement to occur automatically. Since the projection of the circular orbit of the application or pressing elements onto the turntable is an ellipse, an essentially total synchronization with the larger orbit of the receptacles can be achieved with small circular orbits.

With a suitable combination of the diameter of the orbit of the application or pressing elements and the inclination, the require synchronization and stroke of the application or pressing elements can be optimized. Finally, with the application or pressing station according to the present invention, it is possible to use a relatively small support that, in contrast to the application or pressing stations described above, does not take up most of the space above the transport star wheel.

In one embodiment of the present invention, each application or pressing element is mounted so that it swings in pendulum fashion around an axis tangential to the orbit of the support to compensate for minor deviations between the orbits. Each application or pressing element is, thereby, prepositioned by a spring against a stop, so that the application or pressing element, when lowered, does not contact the bottle top in a random pivoting position. In isolated cases, however, the dead weight of the loosely suspended application or pressing element may suffice for the prepositioning.

Preferably, the support of the application or pressing elements is supported by a height adjustable bracket. In this manner, the application or pressing station can be easily adjusted to accommodate bottles of different heights.

In a further embodiment of the present invention, the support is coupled by a universal joint with a central drive shaft in the transport star wheel.

One aspect of the invention resides broadly in a system for pressing foil sheets on the necks of bottles including a rotatable bottle transport device for transporting bottles around a portion of a generally circular path. The generally circular path defines a plane and a first rotation axis. The rotatable bottle transport device is rotatable about the first rotation axis. The first rotation axis is generally orthogonal to the plane defined by the generally circular path. The foil pressing device is for pressing foil sheets on bottles. The support apparatus is for rotatably supporting the foil pressing device above the bottle transport device. The support apparatus is for positioning the foil pressing device on bottles to press foil sheets thereon. The support apparatus is rotatable about a second rotation axis. The rotatable bottle transport device and the support apparatus are relatively positioned such that the first rotation axis diverges from the second rotation axis to form an obtuse angle therebetween.

Another aspect of the invention resides broadly in a bottle labelling machine for pressing labels on bottles including a rotatable bottle transport device for transporting bottles along a first path. The first path defines a generally horizontal first plane and a first diameter. The label pressing device is for pressing labels on bottles. The support apparatus is for supporting the label pressing device above the bottle transport device. The support apparatus is for rotating the label pressing device along a generally circular second path. The generally circular second path defines a second plane and a second diameter. The bottle transport device and the support apparatus are for being relatively positioned such that the generally horizontal first plane forms a generally diverging angle with the second plane. The projection of the horizontal component of the generally circular path of the support apparatus is for forming a generally elliptical pattern on the generally horizontal first plane.

In summing up, the invention includes a pressing station for foil sheets applied around the top and neck of bottles in a labelling machine. The labelling machine has a foil sheet transfer station located along a turntable for the bottles which transfers the foil sheets to the bottles. It also includes a delivery star wheel in which, corresponding to each receiving spot for the bottles located on its circumference, there is a bell-shaped pressing element which can be moved by a cam controlled drive mechanism axially toward the bottle top, and wherein the pressing element is held by a support located above the delivery star wheel which rotates with the delivery star wheel. The pressing station comprises a pressing element supported on the free end of a rocker which can be adjusted in an axial plane. The other end is moved axially during the rotation of the pressing element around the axis of the delivery star wheel by a three-dimensional cam drive mechanism, and the free end is moved radially by a cam drive mechanism coupled with the rocker, as a function of the axial movement of the rocker. The cams of the two cam drive mechanisms are designed so that the pressing element is in its raised inside position in the vicinity of the turntable and is in its lower outside position in a portion of the region between the turntable and the delivery of the delivery star wheel.

Another embodiment of the invention includes an apparatus which is for pressing attached foil sheets around the top and neck of bottles. The apparatus includes an arrangement for transporting the bottles and foil sheets along a predetermined path of travel to a transfer station. Also included is an arrangement for transporting the bottles and foil sheets along a predetermined path of travel from the transfer station to a pressing station. An arrangement in the pressing station is included for pressing the foil sheets around the top and neck of the bottles. The arrangement for pressing the foil sheets comprises an operative arrangement for moving the foil pressing arrangement transversely, with respect to the path of travel of the bottles to the pressing station, from a retracted position out of the predetermined paths of travel to an extended position above the top of the bottles.

Yet another embodiment of the invention includes a method for pressing attached foil sheets around the top and neck of bottles. The method comprises the steps of transporting the bottles and foil sheets along a predetermined path of travel to a transfer station. Next, the bottles and foil sheets are transported along a predetermined path of travel from the transfer station to a pressing station. Finally, the foil pressing arrangement is moved transversely with respect to the path of travel of the bottles to the pressing station, from a retracted position out of the predetermined paths of travel to an extended position above the top of the bottles.

BRIEF DESCRIPTION OF THE DRAWINGS

The following Description of the Preferred Embodiments may be better understood when taken in conjunction with the appended drawings in which.

DESCRIPTION OF THE PREFERRED EMBODIMENTS

Figure 1:
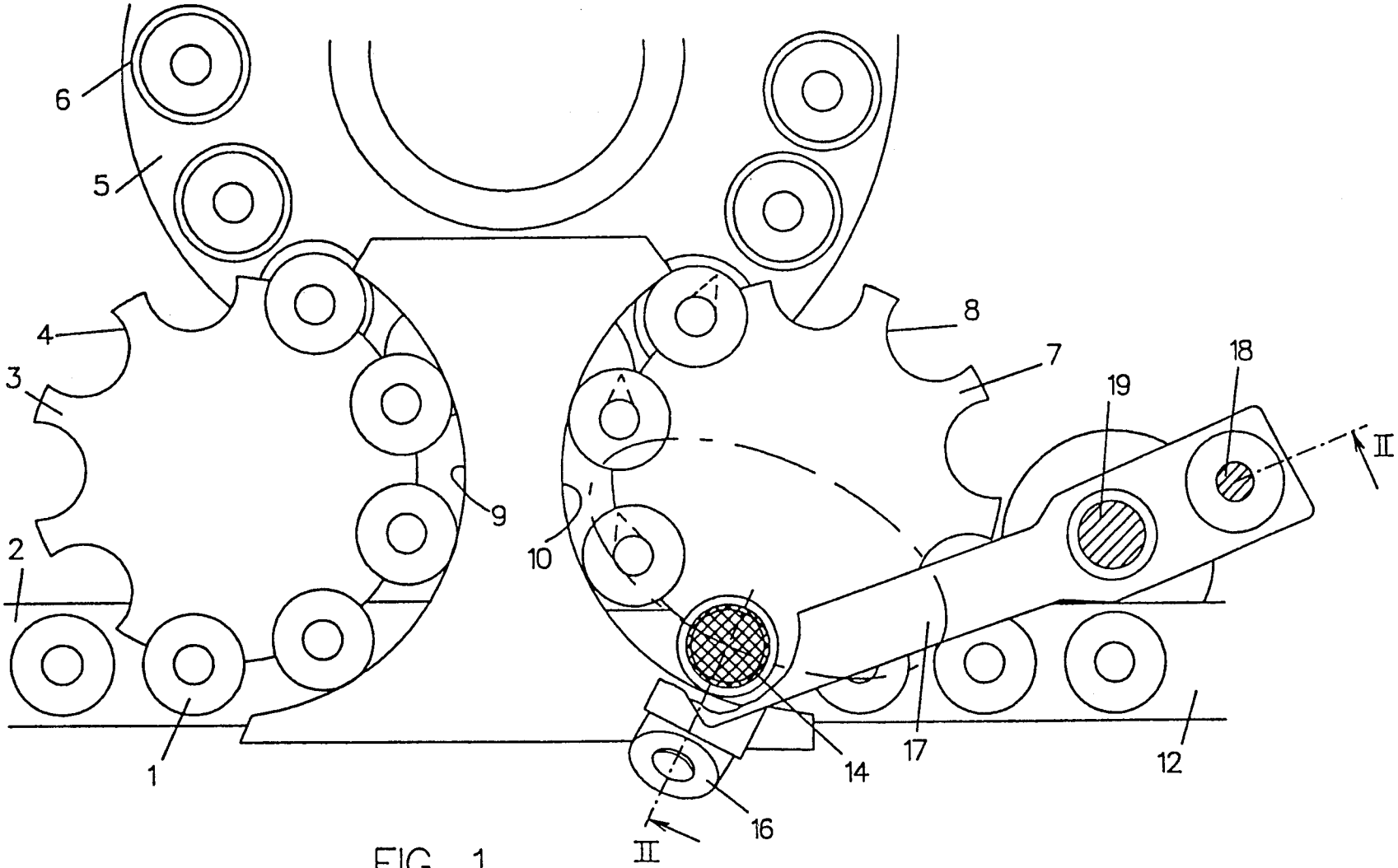
FIG. 1 is a schematic view of a section of a labelling machine according to the present invention.
Figure 2:
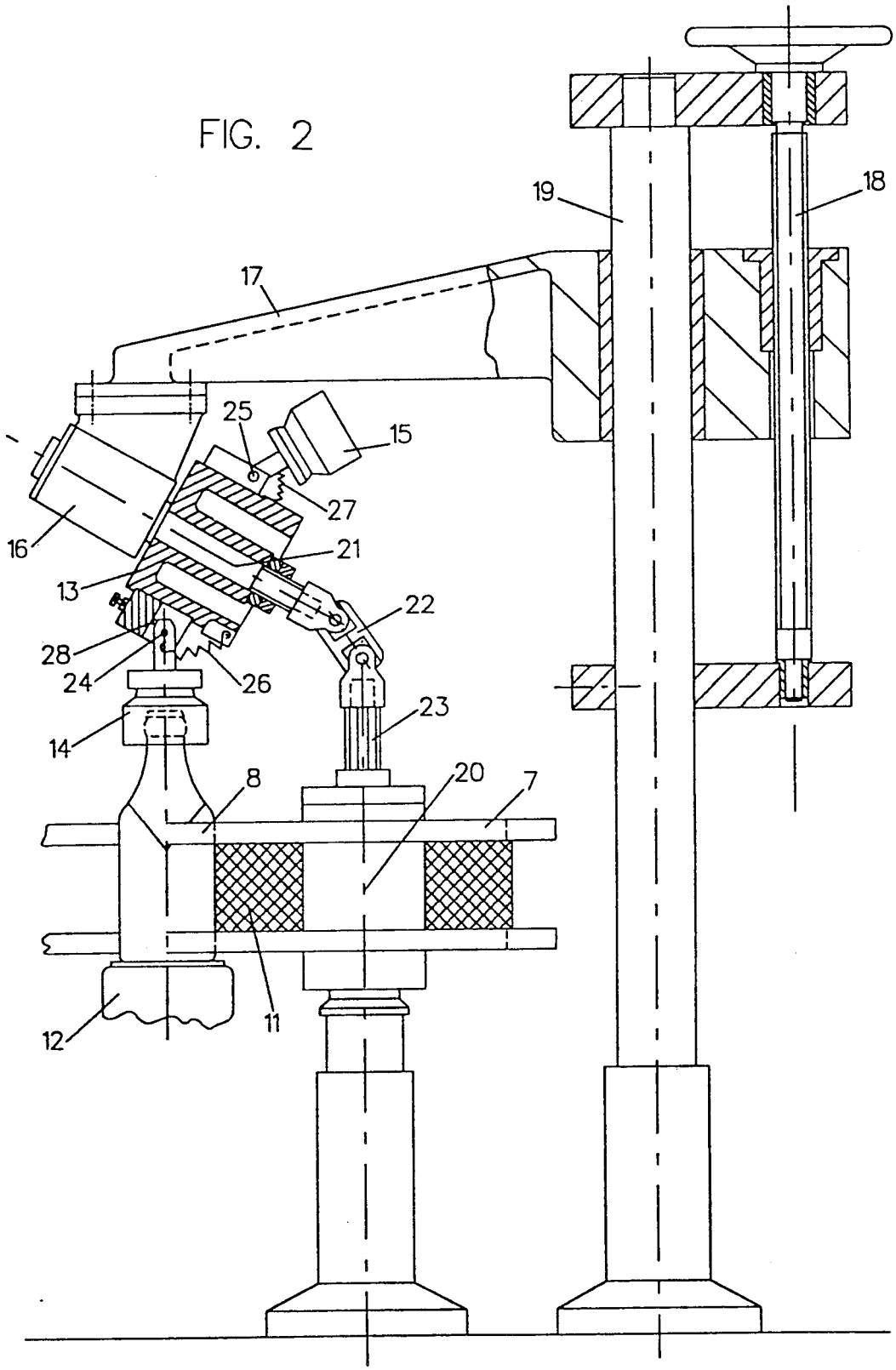
FIG. 2 is a side elevational, partially in section, of the labelling machine of FIG. 1, taken along line II—II in FIG. 1.

In the embodiment of the invention shown in FIGS. 1 and 2, bottles 1, that are to be provided with foil sheets, are transported by a conveyor 2 and by a feeder star wheel 3 with receptacles 4 located on its outside circumference to a turntable 5. From the turntable 5, bottles 1 are transported to a discharge star wheel 7, while being axially braced between cam-controlled rotary plate 6 and a centering head (not shown). The bottles 1, during transport, are provided by a mechanism associated with the turntable 5 with foil sheets on the neck and top of the bottles 1. The bottles with the foil sheets placed around the necks thereof arrive at the discharge star wheel 7 with the tips of the foil sticking out, wherein the projecting tips are folded down by a stationary folding element (not shown), which is located above the bottle top in the transport position of the bottles.

The bottles 1 are held in receptacles 8 in the discharge star wheel 7. Corresponding to both the receptacles 4 of the feeder star wheel 3 and the receptacles 8 of the discharge star wheel 7, there are curve-shaped guides 9 and 10 that hold the bottles 1 in the receptacles 4 and 8. The bottles 1 slide along guides 9 and 10. In the receptacles 8, bottles 1 are supported against rubber cushions 11. Since the guide 10 exerts a slight friction against the bottles 1, and the rubber cushions 11 exert a great deal of friction against bottles 1, the bottles 1 cannot twist out of position in the area of the discharge star wheel 7. From the discharge star wheel 7, the bottles 1 are transported to a conveyor 12 that is used for their discharge.

A support 13 is positioned above the discharge star wheel 7. Application elements 14 and 15 are located on the circumference of support 13. The support 13 is mounted so that it can rotate in a bearing 16 that is supported by a bracket 17. The bracket 17 is mounted on a column 19 so that its height can be adjusted by means of an adjusting spindle 18.

The application or pressing elements 14 and 15 are bell-shaped and are equipped with a flexible pressure pad which comes into contact with all sides of the bottle when the application or pressing elements 14 and 15 are lowered. Such application or pressing elements themselves are known. See, for example, German Patent No. 37 20 529 A1 and German Patent No. 37 28 958 A1.

The central axes 20 and 21 of the discharge star wheel 7 and the support 13, respectively, form an angle 29 therebetween of about 90 degrees to about 180 degrees, so that the planes of the circular orbits of the receptacles 8 and of the application or pressing elements 14 and 15 are inclined in relation to one another. A universal joint 22 connected to a drive shaft 23 located in the center of the discharge star wheel 7 drives the support 13. The longitudinal axis of shaft 23 is parallel to the central axis 20 of the discharge wheel 7. The application or pressing elements 14 and 15 are suspended so that they can swing in pendulum fashion around pivot axes 24 and 25, respectively. The application or pressing elements 14 and 15 are moved tangential to the orbit of the support 13 and are held in position by springs 26 and 27 against an adjustable stop 28.

As shown most clearly in FIG. 1, the selection of the radius of the circular orbit of the application or pressing elements 14 and 15 and the inclination of that orbit relative to the orbit of the discharge star wheel 7 determine the stroke movement of the application or pressing elements 14 and 15 and the relative synchronization of the two orbits. The greater the inclination of the orbit, the larger the stroke. Therefore, one is able to define the optimal combination of the stroke and the synchronization, wherein a minor deviation of synchronization on account of the pivoting mounting of the application or pressing elements 14 and 15 and of the compensation action of the flexible pressure pad of the application or pressing elements is not critical.

Figure 3:
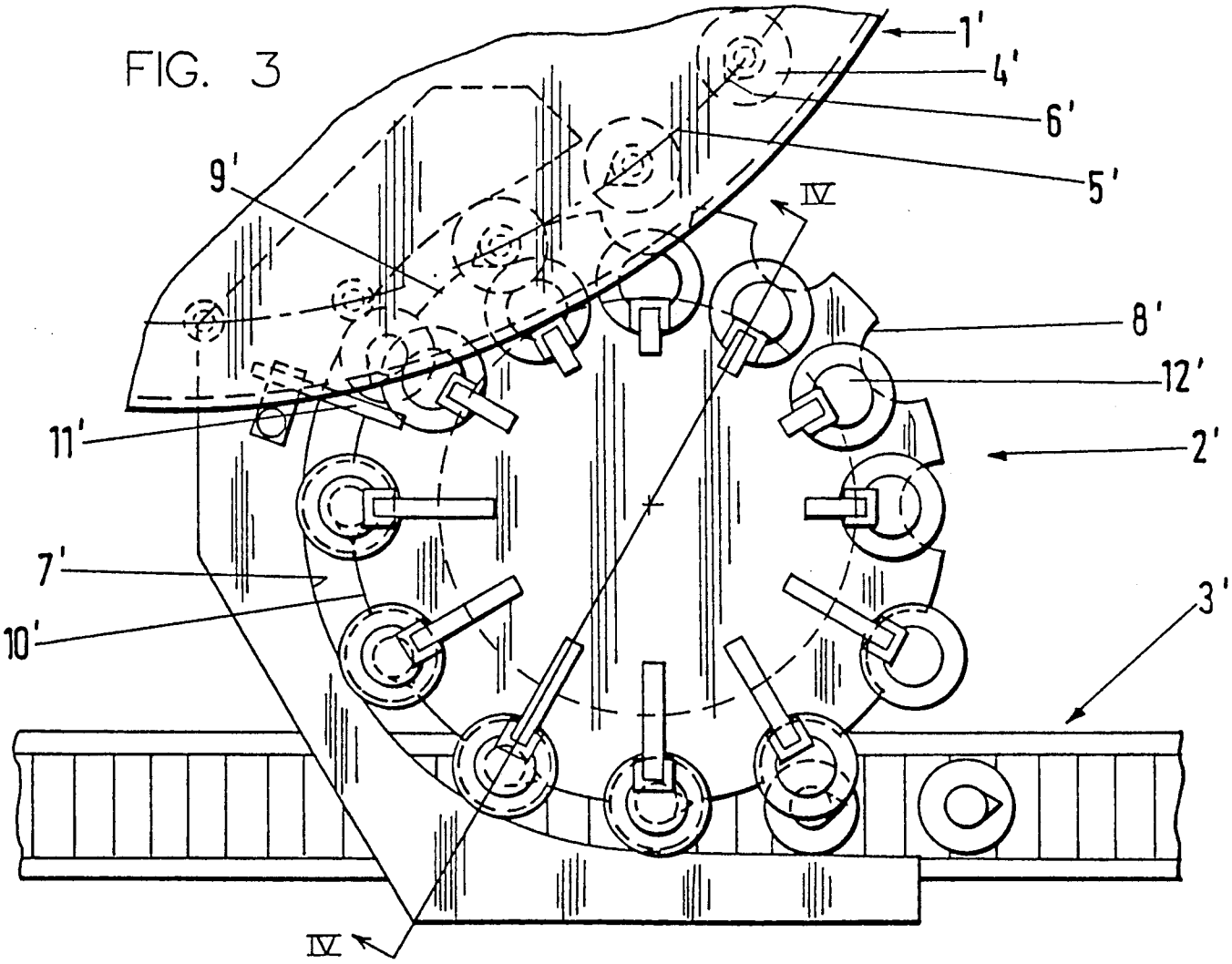
FIG. 3 shows a pressing station as part of a labelling machine, schematically and in a plan view.

Another embodiment of the invention is shown in FIGS. 3–10. FIG. 3 is a schematic illustration of a labelling machine, showing only a turntable 1', a delivery star wheel 2' and a plate or platform conveyor belt 3'. On bottles 4' which are transported by the turntable 1' on a circular transport path 5', foil sheets 6' are applied by a transfer station located in a fixed position on the transport path 5', but not shown, and are then pressed against the neck of the bottle by brushes, also not shown. Since the bottles 4' during this transport are held in place by centering heads which engage the top of the bottle, the foil sheets 6' cannot lie flat on the end surface of the bottle top while the bottles 4' are held by the centering head. By means of a guide element 7' projecting into the transport path 5', the bottles, after being released from the axial bracing, are transferred from their receiving positions in the turntable 1' to receiving positions 8' on the outside circumferences of the delivery star wheel 2', and are held by the guide element 7' over the remaining transport distance into the receiving positions 8' until they are delivered onto a plate or platform conveyor belt 3'. So that the bottles 4' do not slip inside the receiving positions 8', these receiving positions 8' are lined with non-slip elements.

In segment 9' of the transport path of the bottles 4', which forms the transition between the transport path 5' in the turntable 1' and the transport path 10' in the delivery star wheel, there is a fixed folding element 11', which as each bottle passes, folds back the peak of the foil sheet 6' projecting beyond the top of the bottle. For each receiving position 8', there is a pressing element 12' as shown schematically in FIG. 3, which is located in different radial positions as a function of its position on the circulation path 10'. In the vicinity of the turntable 1' it is in its inside position, so that a collision-free passage is possible on the turntable 1', in particular past its centering elements, while in the segment between the turntable 1' and the delivery, it is in its radially outside position. As FIG. 3 shows, the activation begins very early, namely as far back as in the vicinity of the folding mechanism 11'.

Figure 4:
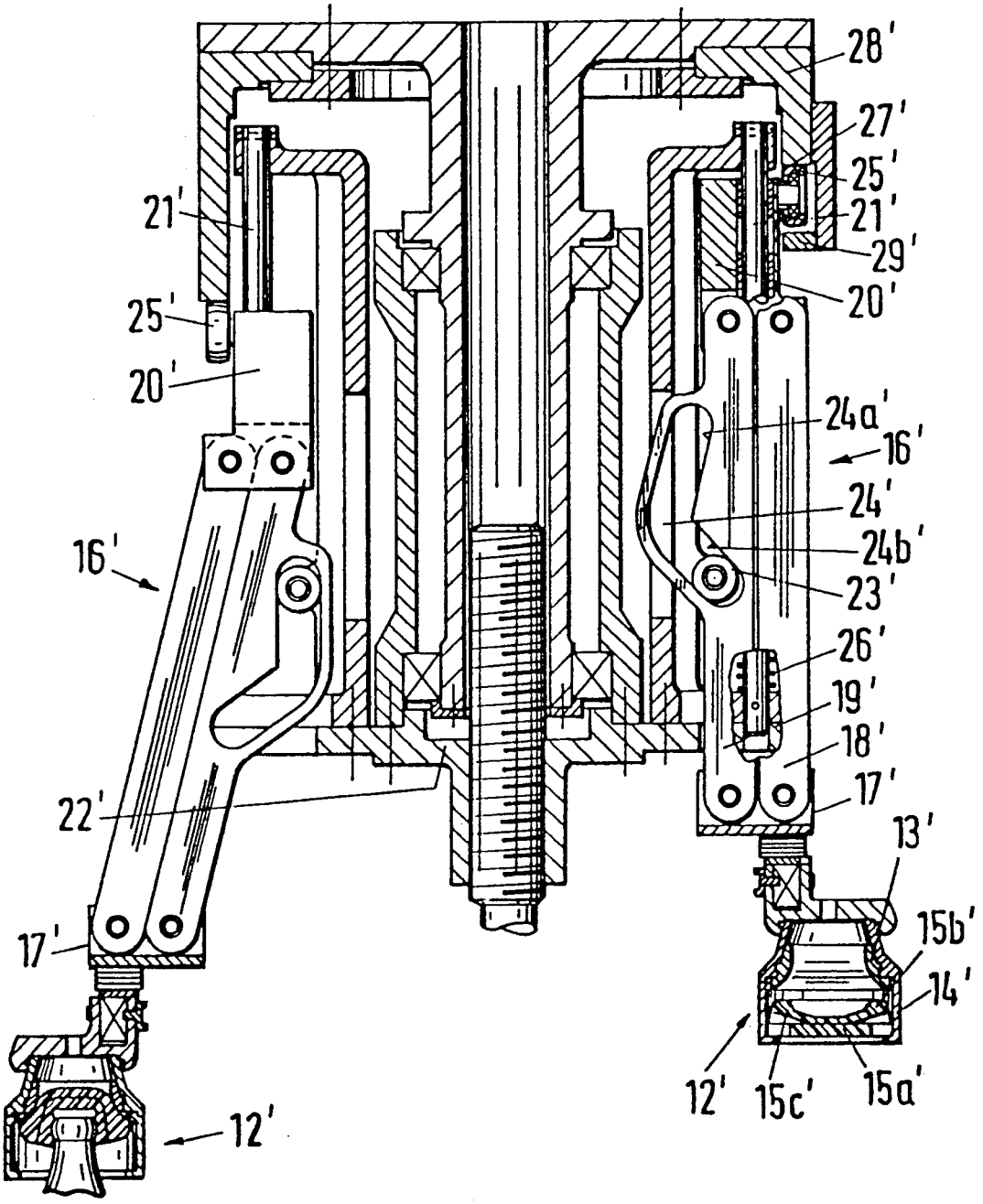
FIG. 4 shows a support with pressing elements in an axial section along line IV—IV in FIG. 3.

In FIG. 4, on the left, the pressing element 12' is shown in the lower, radially outside position, and on the right, in the upper, radially inside position. The pressing element 12' consists of a bell-shaped housing 13' and a two-layer plate 15*a*', 15*b*' held in front of the opening of the housing 13' by means of a support ring 14'. The plate 15*a*', 15*b*' has a ring-shaped bulge 15*c*' on its back side, and is supported with its ring-shaped bulge 15*c*' against the bell-shaped inside wall of the housing 13'. The plate 15*a*', 15*b*' has ribs running radially to the peripheral edge, in the undeformed state enclosing spaces between them, which in the deformed state are in non-overlapping contact in the top and neck area of the bottle 4'. Such a pressing element or a similar one is the object of German Laid Open Patent Application P 37 20 529.3 and German Patent Application P 37 28 958.6.

The pressing element 12' is supported by a duplex crank 16' designed as a parallel crank, and in particular by its coupling element 17'. The two rockers 18', 19' of the duplex crank 16' are supported by its fixed link 20', which is mounted on two parallel guide rods or rails 21' (shown) so that it will not rotate or pivot, but so that it can be displaced axially. The rails 21' are held in a support 22', which is mounted on the delivery star wheel 2' and is driven jointly with the latter. An engagement element 23' of a cam drive mechanism is also mounted in the support 22' so that it can rotate, and includes a slot cam 24' on the rocker 19'. The slot cam 24' comprises two segments 24*a*', 24*b*'. Segment 24*a*' is used for the axial movement, and segment 24*b*' for a combined axial and radial movement of the pressing element 12'.

The fixed link 20' supports, as the engagement element of a three-dimensional cam drive mechanism, a roller 25', which is pressed by means of a spring 26' acting on the fixed link 20' against a corresponding cylinder cam 27', which is supported by a frame 28' which does not rotate. There is a support element 29' opposite the cylinder cam 27', primarily in the region of the turntable 1', to prevent the pressing element 12' from moving under its own weight, if the spring 26' breaks, rom the inside radial position shown on the right in FIG. 4 to the outside radial position shown on the left.

During operation, the pressing elements 12' reach the top inside radial position in the region adjoining the turntable 1'. In this position they lie outside the area traversed by the centering heads, which are still active here. As soon as the centering heads are raised and the bottles 4' are released by the guide element 7' for their transfer to the delivery star wheel 2', the three-dimensional cam drive mechanism 25', 27' lowers the duplex crank 26' with the pressing element 12'. During this descending movement, on account of the curvature of the segment 24b' of the slot cam 24', there is a radial movement of the pressing element 12' outward, until the end of this segment is reached. As the descent continues, then, the rest of the movement is an axially parallel descent, because in this movement segment, the segment 24a' of the slot cam runs parallel to the descent produced by the rails 21'. During this second segment of the movement, the rockers 18', 19' are already in contact with one another and brace one another. Therefore they absorb the reaction force which occurs during pressing, without transmitting this force to the cam drive mechanism 23', 24'. Shortly before the delivery on the platform or plate conveyor belt 3', the duplex crank 16' is again raised, so that the bottles 4' with foil pressed on all sides can be transferred to the platform or plate conveyor belt 3'.

Figure 5:
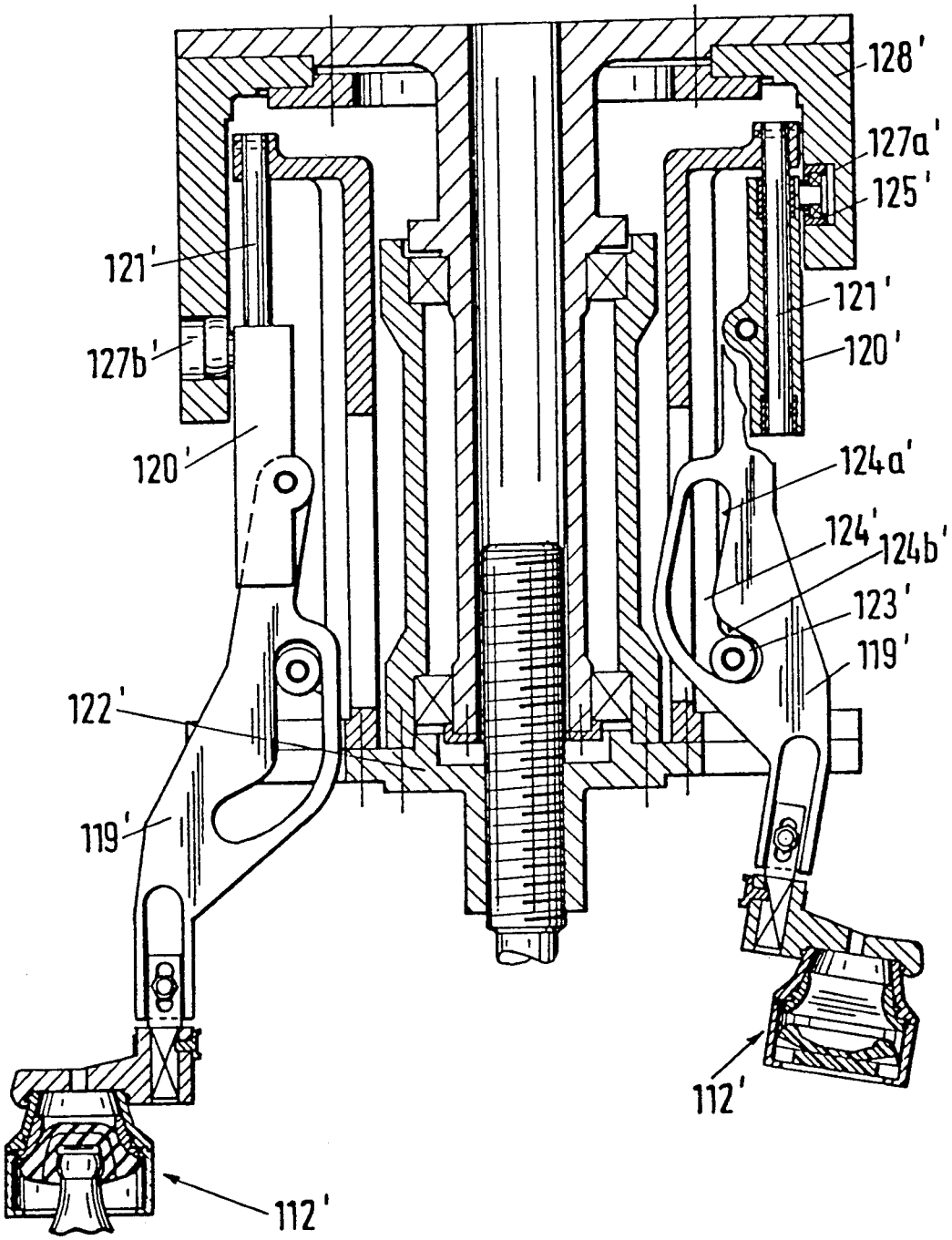
FIG. 5 shows a support with pressing elements in an axial section along line IV—IV in FIG. 3, in a model which is different from the one illustrated in FIG. 4.
Figure 6:
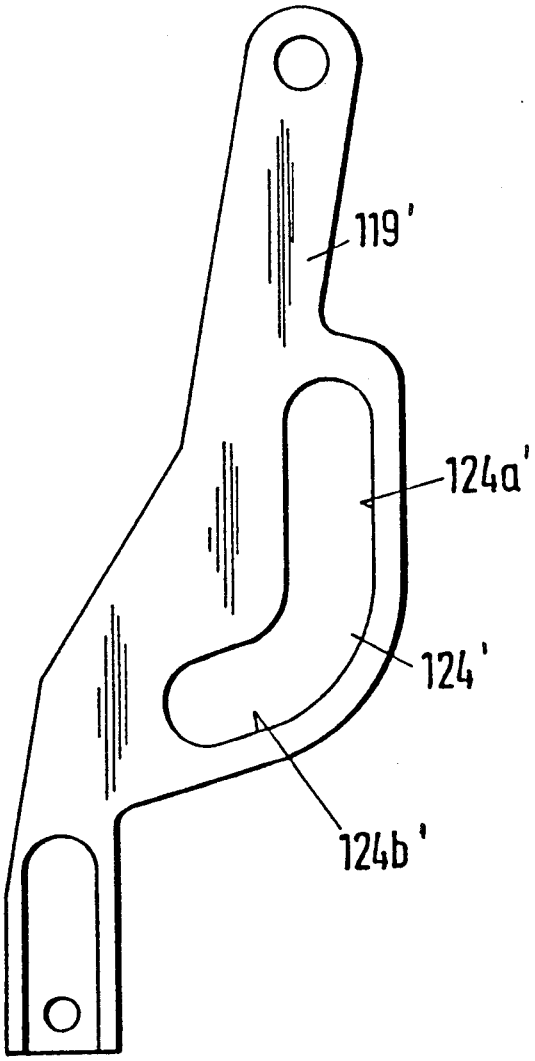
FIG. 6 shows the rocker of the three-dimensional cam drive mechanism illustrated in FIG. 5, in a side view.
Figure 7:
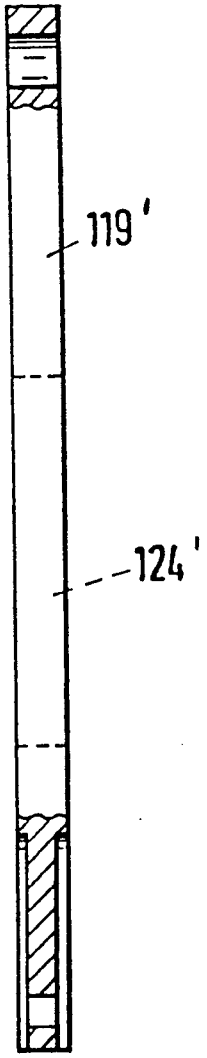
FIG. 7 shows a front view of the rocker illustrated in FIG. 6, with portions broken away to show certain details.

The embodiment illustrated in FIGS. 5 to 7 is the same as the embodiment illustrated in FIG. 3, except for the supports of the cams and the rockers. Identical parts have therefore been identified by the same number, plus 100. The support of the three-dimensional cam drive mechanism 128' is designed as a cylindrical drum. Its cam comprises a flat curve segment 127a' lying in a radial plane, and a three-dimensional cam segment 127b' which extends over several radial planes. The plane cam segment 127a' is designed as an closed slot cam, while the three-dimensional cam segment 127b' is designed as an open slot cam. In this cam 127a', 127b', a roller 125' is guided as the engagement element of a fixed link 120' of a rocker 119'. The fixed link 120' is mounted on two parallel rails or guide rods 121' (shown) so that it cannot rotate or pivot, but so that it can move axially. On the free end of the rocker 119' designed as a one-armed lever, a pressing element 112' is rigidly mounted, so that the pressing element 112' is oriented diagonally in the raised position, and in the lowered position, its axis is parallel to the axis of the bottle.

As in the embodiment illustrated in FIG. 4, the cam 124' of the rocker 119' consists of two cam segments 124a', 124b', where the cam segment 124b' causes the radial movement and the cam segment 124a' the axially parallel guidance during lowering. The cam segment 124b' on the one hand and the three-dimensional cam segment 127b' of the three-dimensional cam drive mechanism on the other hand are matched to one another, so that during the transition from the flat cam segment 127a' into the three-dimensional cam segment 127b', when the descending movement is still small in relation to the rotational movement, the degree of radial deflection caused by the cam segment 124b' is large and becomes smaller with increasing axial movement. In this manner, the load on the cams is made more uniform. This arrangement of the curves of the cams is not limited to the embodiment illustrated in FIG. 5, but can also be used in the embodiment illustrated in FIG. 4.

Figure 8:
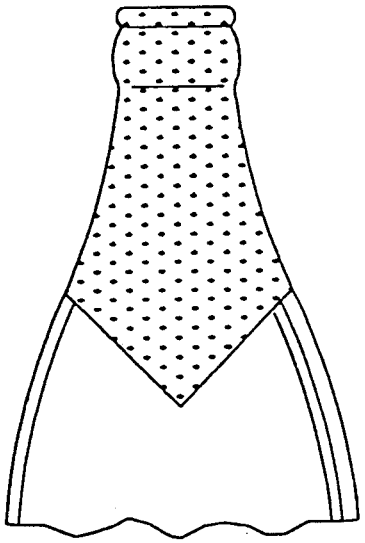
FIGS. 8 and 9 show a partial front elevational view of bottles with labels attached by the apparatus of the present invention.
Figure 9:
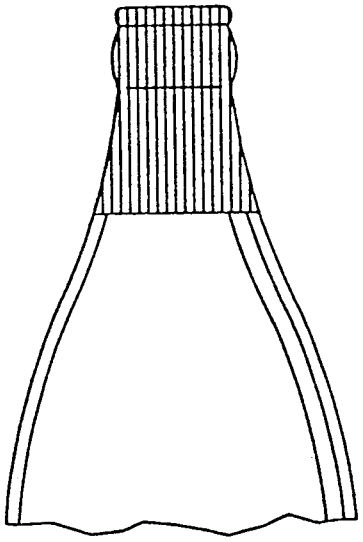
Figure 10:
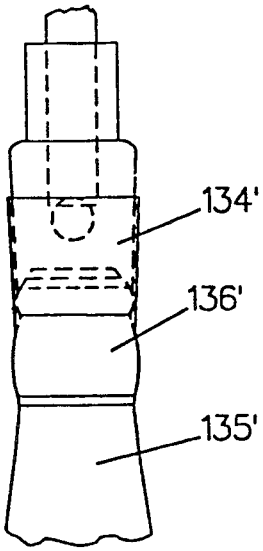
FIG. 10 shows a partial front elevational view of a bottle which is engaged by the apparatus of the present invention.

Shown in FIG. 10 is a typical centering head 134' having a slightly trunconical outer periphery and which, at the bottom, has a diameter that is the same as the diameter of the bottle top 136', while at its upper part it has a slightly larger diameter. Also shown is a foil patch or sheet 135' which may be pressed in the apparatus of this invention to have a finished appearance, such as shown in FIGS. 8 and 9.

In summary, one feature of the invention resides broadly in an application station for foil sheets placed on the neck and top of bottles, consisting of a transport star wheel 7 rotating around a first axis of rotation 20 with receptacles 8 located on its circumference for the bottles 2 and of application elements 14, 15 which can be lowered onto the tops of the bottles and which are located on the circumference of a support 13 located above the transport star 7, and rotating around a second axis of rotation 21 offset in relation to the first axis of rotation 20, whereby the orbits of the receptacles 8 and of the application elements 14, 15 are synchronized with one another over a section lying between the entrance of the bottles into the transport star 7 and the exit of the bottles from the transport star 7, in which segment the application elements 14, 15 are lowered, characterized by the fact that the planes of the orbits of the receptacles 8 and of the application elements 14, 15 are inclined in relation to one another such that the required stroke movement of the lowerable application elements results directly from their orbit.

Another feature of the invention resides broadly in an application station characterized by the fact that each application element 14, 15 is mounted so that it can swing in pendulum fashion around an axis 24, 25 tangential to the orbit of the support 13.

Yet another feature of the invention resides broadly in an application station characterized by the fact that each application element 14, 15 is pre-positioned by a spring 26 27 at a stop.

A further feature of the invention resides broadly in an application station characterized by the fact that the support 13 is coupled by means of a universal joint 22 with a central drive shaft 23 in the transport star wheel 7.

Another aspect of the invention resides in a pressing station or metal foil sheets 6' applied around the top and neck of bottles 4' in a labelling machine with a transfer station located on the turntable 1' for the bottles 4' which transfers the metal foil sheets 6' to the bottles 4'. Also included is a delivery star wheel 2', in which corresponding to each receiving spot 8' for the bottles 4' located on its circumference, there is a bell-shaped pressing element 12', 112', alternatively known as means for pressing, which can be moved by a cam controlled drive mechanism axially toward the bottle top. The pressing element 12', 112' is held by a support 22', 122' located above the delivery star wheel 2' which rotates with the delivery star wheel 2'. The pressing element 12', 112' is supported on the free end of a rocker 19', 119' which can be adjusted in an axial plane and includes operative means for moving the pressing element. The other end is moved axially during the rotation of the pressing element 12', 112' around the axis of the delivery star wheel 2' by a three-dimensional cam drive mechanism 25', 27', 125', 127a', 127b', and the free end is moved radially by a cam drive mechanism 23', 24', 123', 124' coupled with the rocker 19', 119', as a function of the axial movement of the rocker 19', 119'. The cams 24', 27', 124', 127' of the two cam drive mechanisms 23', 24', 25', 27', 123', 124', 125', 127' are designed so that the pressing element 12', 112' is in its raised inside position in the vicinity of the turntable 1' and is in its lower outside position in a portion of the region between the turntable 1' and the delivery of the delivery star wheel 2'. The cam 24', 124' of the cam drive mechanism 23', 24', 123', 124' is coupled with the rocker 19', 119' which comprises several segments 24a', 24b', 124a', 124b'. Its first segment 24b', 124b' is active during the downward movement and has at least one radial control component and the segment 24a', 124b' which is active during the pressing of the foil sheet has only one axial component. The cams 124', 127' of the two cam drive mechanisms 23', 24', 25', 27', 123', 124', 125', 127' are designed so that an initially slow descending movement of the rocker 19', 119' corresponds to a large radial movement. The cam 27', 127' of the three-dimensional cam drive mechanism 25', 27', 125', 127' lies on a drum jacket surface, in particular one which is cylindrical. The cam located on the drum jacket surface of the three-dimensional cam drive mechanism 25', 27', 125', 127' is designed as a support cam for the engagement element 25', 125' of the three-dimensional cam drive mechanism 25', 27', 125', 127', which absorbs the axial reaction force of the pressing element 12', 112' on the bottle top. The rocker 19' is part of a duplex crank 16', whose coupling element 17' supports the pressing element 12' and whose fixed link 20' is axially moved by the three-dimensional cam drive mechanism 25', 27'. The duplex crank 16' is a parallel crank. The rockers 18', 19' of the duplex crank 16' are braced against one another in their outside radial position. The rocker 119' is designed as a one-armed lever, to which the pressing element 112' is rigidly fastened. The rocker 19' is prestressed by a spring 26', which presses the contact element 25' of the three-dimensional cam drive mechanism 25', 27' against the support cam 27'. The cam 127' of the three-dimensional cam drive mechanism 125', 127' has a plane cam segment 127a' which lies a radial plane, and a three-dimensional cam segment 127b' which extends over several radial planes, and is designed on the inside as a drum-shaped support, whereby the plane curve segment 127a' is designed as a closed slot cam, and the three-dimensional cam segment 127b' is designed as a radially open slot cam.

All, or substantially all, of the components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A system for pressing foil sheets onto the tops and necks of bottles, said system comprising:

rotatable bottle transport means for transporting bottles around a portion of a generally circular path;

said generally circular path defining a plane and a first rotation axis;

said rotatable bottle transport means being rotatable about said first rotation axis;

said first rotation axis being generally orthogonal to said plane defined by said generally circular path;

a plurality of foil pressing means for pressing foil sheets onto the tops and necks of bottles;

support means for rotatably supporting said plurality of foil pressing means above said bottle transport means;

said support means for lowering a portion, at any one time, of said plurality of foil pressing means onto the tops and necks of bottles to press foil sheets onto the tops and necks of bottles;

said support means and said plurality of foil pressing means being rotatable about a second rotation axis;

said rotatable bottle transport means and said support means being relatively positioned such that said first rotation axis diverges from said second rotation axis to form a substantial angle therebetween; and said first rotation axis diverges from said second rotation axis to form a substantial angle therebetween to thereby configure said support means and said plurality of foil pressing means such that rotating said plurality of foil pressing means directly results in lowering a portion, at any one time, of said plurality of foil pressing means onto the tops and necks of bottles to press foil sheets onto the tops and necks of bottles.

2. The system of claim 1, wherein said substantial angle is an obtuse angle.

3. The system of claim 2, wherein said foil pressing means is pivotally supported by said support means.

4. The system of claim 3, further including biasing means for biasing the pivoting of said foil pressing means on said support means.

5. The system of claim 4, further including stop means for limiting the amount of said pivoting of said pressing means on said support means.

6. The system of claim 5, further including first drive means for rotating said pressing means on said support means.

7. The system of claim 6, wherein:

said first drive means includes a shaft; and the longitudinal axis of said shaft is generally parallel to said first rotational axis.

8. The system of claim 7, wherein said shaft is connected to said pressing means by a flexible connector.

9. The system of claim 8, wherein said flexible connector is a universal joint.

10. The system of claim 9, wherein said biasing means is a spring.

11. The system of claim 10, further including height adjuster means for adjusting the height of said support means above said plane defined by said generally circular path.

12. The system of claim 11, further including guide means for guiding the bottles along said generally circular path.

13. The system of claim 12, wherein said guide means includes a resilient surface member.

14. The system of claim 13 wherein:

said rotatable bottle transport means is a transport star wheel having an entrance and an exit;

said transport star wheel including a plurality of bottle receptacles;

said star wheel defining a perimeter;

said bottle receptacles being positioned at said perimeter of said transport star wheel;

said bottle receptacles for orbiting about said first rotation axis;

said foil pressing means for orbiting about said second rotation axis;

said orbit of said bottle receptacles and said orbit of said foil pressing means being synchronized with one another such that said foil pressing means is lowerable from above an area of said transport star wheel, said area being between said entrance of said transport star wheel and said exit of said transport star wheel;

said support means defining a pendulum axis, said pendulum axis being tangential to said orbit of said foil pressing means;

said pivotally supported foil pressing means being swingable in a pendulum fashion about said pendulum axis;

said stop means for limiting the swinging of said foil pressing means in said pendulum fashion;

said foil pressing means being positioned by said spring and adjacent said stop means; and said shaft being positioned generally at the center of said transport star wheel.

15. A machine for pressing foil sheets onto the tops and necks of bottles comprising:

rotatable bottle transport means for transporting bottles along a first path;

said first path defining a generally horizontal first plane and a first axis of rotation;

said rotatable bottle transport means being rotatable about said first axis of rotation;

said first rotational axis being generally orthogonal to said plane defined by said first path;

a plurality of foil pressing means for pressing foil sheets onto the tops and necks of bottles;

support means for supporting said plurality of foil pressing means above said bottle transport means;

said support means for rotating said plurality of foil pressing means along a generally circular second path and said support means for lowering a portion, at any one time, of said plurality of foil pressing means onto the tops and necks of bottles to press foil sheets onto the tops and necks of bottles;

said generally circular second path defining a second plane and a second axis of rotation;

said bottle transport means and said support means being relatively positioned such that said generally horizontal first plane forms a generally diverging angle with said second plane;

the projection of the horizontal component of said generally circular path of said support means for forming a generally elliptical pattern on said generally horizontal first plane; and said generally horizontal first plane forms a generally diverging angle with said second plane to thereby configure said support means and said plurality of pressing means such that said rotating of said plurality of foil pressing means along a generally circular second path directly results in lowering a portion, at any one time, of said plurality of foil pressing means onto the tops and necks of bottles to press foil sheets onto the tops and necks of bottles.

16. The foiling machine of claim 15, wherein said plurality of foil pressing means pivots on said support means.

17. The foiling machine of claim 16, further including adjuster means for adjusting the height of said support means above said bottle transport means.

18. The foiling machine of claim 17, further including biasing means for biasing the pivoting of said plurality of foil pressing means on said support means.

19. The foiling machine of claim 18, further including guide means for guiding the bottles along said generally horizontal path, said guide means having a resilient surface member.

* * * * *